United States Patent [19]

Stice

[11] 4,122,623

[45] Oct. 31, 1978

[54] ADJUSTABLE GUN STOCK

[76] Inventor: Eldon C. Stice, 5201 Churchill Ave., Las Vegas, Nev. 89107

[21] Appl. No.: 837,577

[22] Filed: Sep. 28, 1977

[51] Int. Cl.[2] ..... F41C 23/00

[52] U.S. Cl. ..... 42/73

[58] Field of Search ..... 42/73, 74, 71 R

[56] References Cited

U.S. PATENT DOCUMENTS

| | | | |
|---|---|---|---|
| 183,975 | 10/1876 | Rosee | 42/74 |
| 1,032,628 | 7/1912 | Sherman | 42/74 |
| 1,651,299 | 11/1927 | Stansel | 42/73 |
| 2,669,051 | 2/1954 | Cline | 42/71 R |
| 2,956,343 | 10/1960 | Shaffer | 42/73 |

*Primary Examiner*—Charles T. Jordan

[57] ABSTRACT

This gun stock consists primarily of a comb, which is adjustable in height within opening means of the stock, so as to enable the shooter to have his or her gun custom fitted to his or her requirements for clay bird shooting or target shooting. The comb is elevatable upon a pair of dowels of the stock, and a knurled wheel in the stock, upon a threaded bolt, enables the user to raise or lower the comb, and the structure may be made to accommodate a left hand shooter, as well as a right hand shooter.

1 Claim, 3 Drawing Figures

ADJUSTABLE GUN STOCK

This invention relates to firearms, and more particularly, to an adjustable gun stock.

It is, therefore, the principal object of this invention to provide an adjustable gun stock, which will have an elevatable comb portion, so as to custom fit the shooter.

Another object of this invention is to provide an adjustable gun stock, which will enable the individual shooter to adjust the gun precisely, for clay bird shooting, or target shooting.

A further object of this invention is to provide an adjustable gun stock, which will be adaptable to rifles having telescopic sights, as well as to those having iron sights, or tube sights.

A still further object of this invention is to provide an adjustable gun stock, of the type described, which will have the adjustment means located where it will not impair the shooter in any way, and the structure may be modified, so as to be adaptable for use by a left handed shooter.

Other objects of the invention are to provide an adjustable gun stock, which is simple in design, inexpensive to manufacture, rugged in construction, easy to use and efficient in operation.

These, and other objects, will be readily evident, upon a study of the following specification, and the accompanying drawing, wherein.

Figure 1:
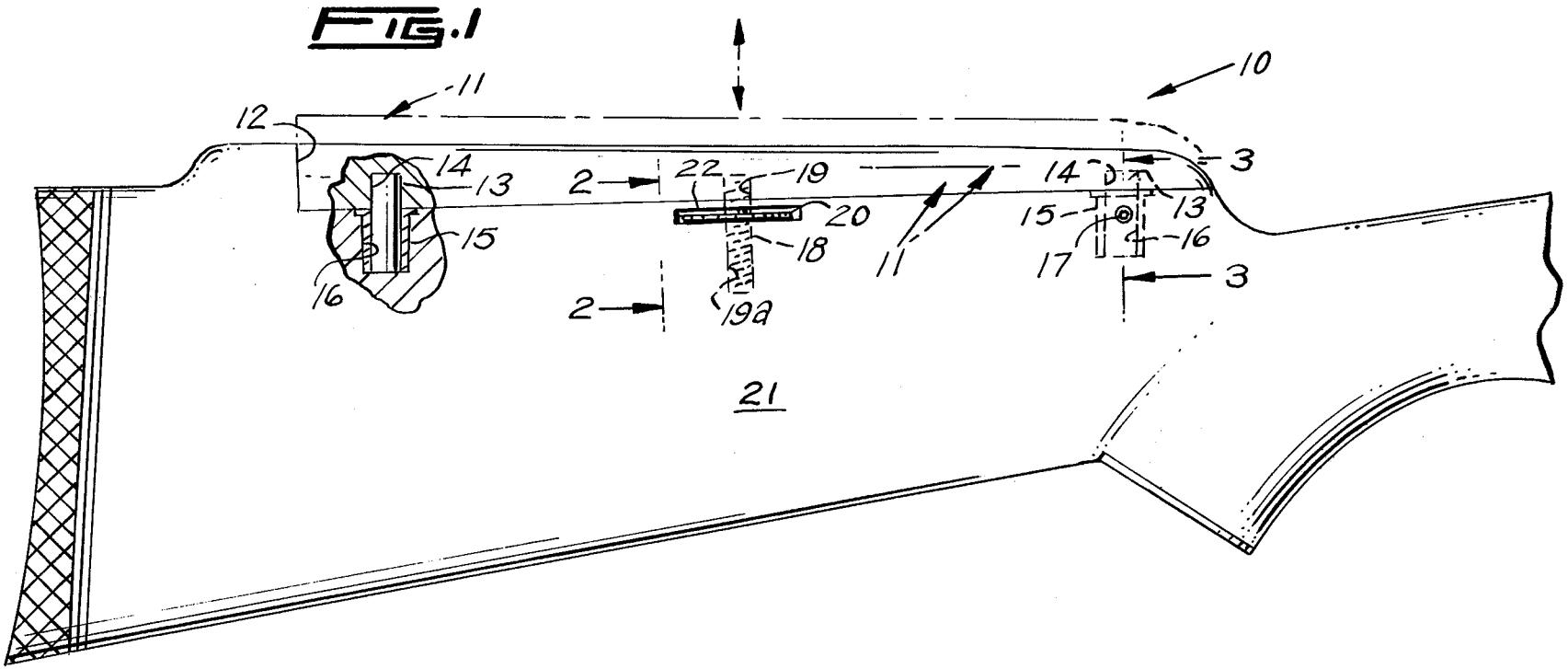
FIG. 1 is a fragmentary side view of a gun stock, shown in elevation and illustrates the adjustable comb thereof.
Figure 2:
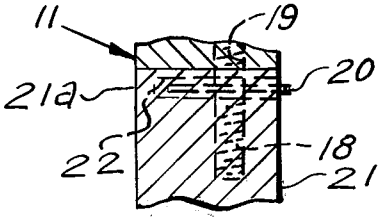
FIG. 2 is a cross-sectional view, taken along the line 2—2 of FIG. 1.
Figure 3:
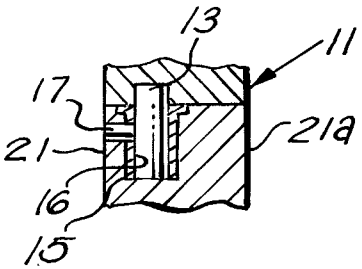
FIG. 3 is a cross-sectional view, taken along the line 3—3 of FIG. 1.

According to this invention, an adjustable gun stock 10 is shown to include an elevatable comb 11, which is received in recessed opening 12. A pair of steel dowel pins 13 are spaced apart and secured fixedly within openings 14 of comb 11. A pair of brass sleeves 15 are fixedly secured, in a suitable manner, within openings 16 of stock 10, and the dowels pins 13 are slideable with sleeves 15. A set screw 17, in sleeves 15, enables the shooter to render the comb 11 secure, at any desired height, by encroaching on the outer peripheries of the dowel pins 13.

A threaded bolt 18, in the center of comb 11, is fixedly secured in opening 19 of comb 11, and is freely received in opening **19*a* of stock 10. A knurled wheel 20 is threadingly received on bolt 18 and a portion of its outer periphery projects from surface 21, of stock 10. Wheel 20 is freely received in slot 22 of stock 10, and, by rotating wheel 20, the user may elevate or lower comb 11, which rides up and down by the dowel pin 13 means, within sleeves 15. When comb 11 is raised to its desired elevation, the dowel pins 13 may be rendered stationary, by tightening the set screws 17**.

It shall be noted, that for left handed shooters, the wheel 20 will extend from the opposite surface **21*a* of stock 10**.

While various changes may be made in the detail construction, it is understood that such changes will be within the spirit and scope of the present invention, as is defined by the appended claims.

What I now claim is:

1. An adjustable gun stock, comprising, in combination, a stock and a comb for customizing said gun stock precisely to individual needs of a shooter, a recessed opening on an upper side of said stock, means for adjustably raising or lowering said comb in said opening, a pair of parallel, spaced-apart dowel pins secured to an underside of said comb and protruding downwardly therefrom, a threaded bolt parallel to said dowel pins being located therebetween and also secured within an underside of said comb and protruding downwardly therefrom; a pair of sleeves are each fitted within an opening on a horizontal upper surface of said recessed opening, said sleeves slidably receiving said down pins, a clearance opening in said upper surface of said recessed opening freely receiving said threaded bolt, said clearance opening intercepting a horizontal slot inside said stock between said recess upper surface, and a lower side of said stock, a knurled wheel freely received in said slot and having a threaded central opening thread engaged on said bolt, said wheel protruding outwardly of one side of said stock for accessibility of manual rotation thereof, and each said sleeve having a set screw in a side thereof for locking against a side of said dowel pins, said set screws extending to said stock side for accessibility of manual rotation thereof.

* * * * *